US006820962B2

(12) United States Patent
Uchida

(10) Patent No.: US 6,820,962 B2
(45) Date of Patent: Nov. 23, 2004

(54) INKJET PRINTER, INKJET PRINTING METHOD, PROGRAM AND STORAGE MEDIUM

(75) Inventor: Haruo Uchida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/465,307

(22) Filed: Jun. 20, 2003

(65) Prior Publication Data

US 2003/0234832 A1 Dec. 25, 2003

(30) Foreign Application Priority Data

Jun. 24, 2002 (JP) ..... 2002-183570

(51) Int. Cl.[7] ..... B41J 2/165

(52) U.S. Cl. ..... 347/36; 347/29; 347/35; 347/22; 347/23

(58) Field of Search ..... 347/35, 36, 22, 347/23, 29, 100

(56) References Cited

U.S. PATENT DOCUMENTS

| | | | | |
|---|---|---|---|---|
| 5,216,450 A | | 6/1993 | Koitabashi et al. | 346/140 R |
| 5,309,180 A | | 5/1994 | Uchida | 346/140 R |
| 5,486,854 A | | 1/1996 | Uchida | 347/30 |
| 5,495,271 A | | 2/1996 | Koitabashi et al. | 347/23 |
| 5,539,435 A | | 7/1996 | Uchida et al. | 347/33 |
| 5,557,310 A | | 9/1996 | Kurata et al. | 347/87 |
| 5,740,181 A | | 4/1998 | Uchida et al. | 347/30 |
| 5,835,109 A | | 11/1998 | Uchida | 347/24 |
| 5,963,227 A | | 10/1999 | Koitabashi et al. | 347/30 |
| 6,168,259 B1 | * | 1/2001 | Capurso | 347/36 |
| 6,239,817 B1 | * | 5/2001 | Meyer | 347/36 |
| 6,412,931 B1 | | 7/2002 | Kurata et al. | 347/86 |
| 6,702,422 B1 | * | 3/2004 | Suzuki et al. | 347/24 |
| 2001/0000669 A1 | | 5/2001 | Uchida et al. | 347/33 |
| 2002/0003554 A1 | | 1/2002 | Hayakawa, et al. | 347/31 |

FOREIGN PATENT DOCUMENTS

| | | |
|---|---|---|
| JP | 2001-260391 | 9/2001 |
| JP | 2001-301201 | 10/2001 |

* cited by examiner

*Primary Examiner*—Shih-Wen Hsieh
*Assistant Examiner*—Ly T Tran
(74) *Attorney, Agent, or Firm*—Fitzpatrick, Cella, Harper & Scinto

(57) ABSTRACT

An inkjet printer has a platen defining the position of printing medium P during image printing and an ink receiver formed in the platen to be opposite to nozzle arrays of a print head. In the inkjet printer, the print head ejects ink from the nozzle arrays for pigment ink and dye ink in accordance with print data. When borderless printing is executed on the edges of printing medium, ink is ejected to lie off printing medium and then received in the ink receiver. Then, the print head ejects dye ink to pigment ink received in the ink receiver of the platen during borderless printing using pigment ink.

21 Claims, 13 Drawing Sheets

INKJET PRINTER, INKJET PRINTING METHOD, PROGRAM AND STORAGE MEDIUM

This application claims priority from Japanese Patent Application No. 2002-183570 filed Jun. 24, 2002, which is incorporated hereinto by reference.

BACKGROUND OF THE INVENTION

1. Field of the Invention

The present invention relates to an inkjet printer, an inkjet printing method, a program and storage medium, and specifically to an inkjet printer, an inkjet printing method, a program and a storage medium used to execute borderless printing on a printing medium.

2. Description of the Related Art

Color inkjet printers capable of executing so-called borderless printing are disclosed in Japanese Patent Application Laid-Open Nos. 2001-301201 and 2001-260391. Generally, in those inkjet printers, ink is ejected from a print head beyond the borders of a printing medium in order to print an image on the entire area of the printing medium. Namely, ink is ejected directly to a platen opposite to the print head so that ink spreads beyond the edges of the printing medium. For this purpose, the platen has an ink receiver receiving ink ejected from the print head to the printing medium beyond the edges thereof during borderless printing on the printing medium. The ink receiver may include an ink absorber for absorbing ink.

Ink used in color inkjet printers includes pigment ink and dye ink. In order to improve the image quality provided by the inkjet printer, pigment ink is preferably used as black ink. However, if pigment ink is ejected to the ink receiver during borderless printing on the printing medium, the pigment ink easily solidifies and accumulates in the ink receiver.

If the accumulation of pigment ink becomes significant in the ink receiver, the accumulated pigment ink comes into contact with the print head and then the periphery of the nozzle array may be stained. If the ink adhering to the print head contacts the printing medium, the image printing face of the printing medium may be stained. Furthermore, if the pigment ink ejected to the ink receiver for borderless printing is solidified and accumulated therein, the ink may clog the ink absorber in the ink receiver. This will deteriorate the absorbing performance of the ink absorber and accelerate the solidification and accumulation of pigment ink in the ink receiver.

Conventionally, pigment ink is not used for the borderless printing, since above described problems occur if executing the borderless printing with pigment ink. It is therefore very important to solve the above problems in order to achieve the borderless printing using pigment ink.

The present invention is directed to overcome one or more of the problems as set forth above.

SUMMARY OF THE INVENTION

The inkjet printer of the present invention is an inkjet printer capable of printing an image on a printing medium by ejecting ink in accordance with print data from a print head including nozzle arrays for pigment ink and dye ink, the inkjet printer comprising: a platen opposite to the print head, the platen defining a position of the printing medium for image printing; and an ink receiver formed in the platen to be opposite to the nozzle arrays of the print head, the ink receiver receiving ink ejected off the printing medium during borderless printing on an edge of the printing medium, wherein dye ink is ejected toward pigment ink received in the ink receiver during borderless printing using pigment ink.

The method of the present invention is an inkjet printing method for an inkjet printer including a platen opposite to a print head having nozzle arrays for pigment ink and dye ink, the platen defining a position of a printing medium for printing with the print head; and an ink receiver formed in the platen to be opposite to the nozzle arrays of the print head, the ink receiver receiving ink ejected off the printing medium during borderless printing on an edge of the printing medium, the method comprising the step of: ejecting dye ink toward pigment ink that has been ejected off the printing medium and received in the ink receiver during borderless printing using pigment ink.

Additionally, a program of the present invention is a program capable of making a computer perform steps included in the above-mentioned method.

Moreover, a storage medium of the present invention is a storage medium for storing the above-mentioned program.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
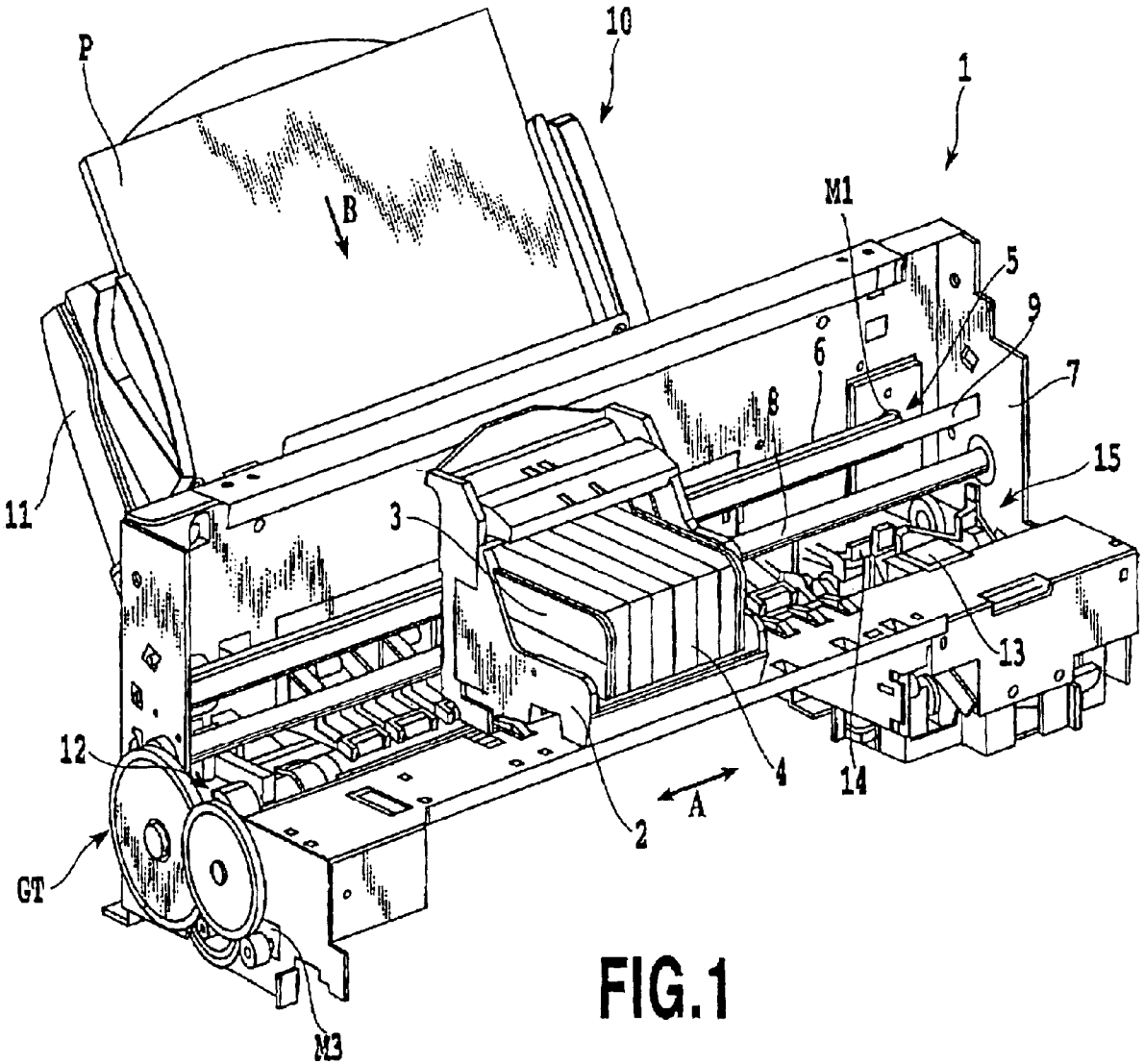
FIG. 1 is a perspective view illustrating a first embodiment of the inkjet printer of the present invention.

The inkjet printer of the present invention is capable of executing so called borderless printing. In the inkjet printer, ink is ejected from a print head so as to spread beyond edges of a printing medium is received by an ink receiver formed in a platen during borderless printing. Also in the printer, dye ink is ejected toward pigment ink received in the ink receiver during borderless printing using pigment ink.

In the present invention, the pigment ink in the ink receiver is diluted by dye ink, or the pigment ink adhering to the ink receiver is dissolved by dye ink. As a result, it becomes possible to prevent the solidification and accumulation of pigment ink in the ink receiver during borderless printing and thereby to improve the image quality and printer reliability.

Preferably, an ink absorber is disposed in the ink receiver, and a waste ink disposal member is disposed under the platen. The ink receiver and the waste ink disposal member are communicated with each other by an ink flow path formed in the platen.

Preferably, the ejection amount of dye ink is varied in accordance with the amount of pigment ink received in the ink receiver during borderless printing.

In such a case, the amount of pigment ink ejected to the ink receiver of the platen for borderless printing is estimated from print data for image printing, then, the amount of dye ink is determined to be large enough to dilute or dissolve the pigment ink in the ink receiver. The amount of dye ink used to prevent the solidification and accumulation of pigment ink in the ink receiver of the platen can thereby be minimized.

Preferably, the ejection of pigment ink for borderless printing and the ejection of dye ink onto the pigment ink received in the ink receiver are executed during one scanning of the print head.

As a result, dye ink can be ejected onto pigment ink within a short time after the pigment ink is received in the ink receiver. Then it becomes possible to ensure the prevention of the solidification and accumulation of pigment ink in the ink receiver of the platen.

Further, dye ink may be ejected onto pigment ink received at a previous scanning in the ink receiver during scanning one or more after the previous scanning.

Further, dye ink may be ejected onto pigment ink received in the ink receiver after a scanning including a pigment ink ejection for borderless printing is completed. That is, dye ink ejection for preventing the solidification and accumulation of pigment ink in the ink receiver of the platen may be carried out as part of an ejection recovering process of the inkjet printer, independently of the regular printing operation.

Further, dye ink may be ejected onto pigment ink in the ink receiver after a predetermined period of time has lapsed since the pigment ink is received in the ink receiver during borderless printing. In such a case, the amount of dye ink ejection may be varied in accordance with the lapse of time after pigment ink is received in the ink receiver.

Preferably, the dye ink includes cyan ink, magenta ink and yellow ink, while the pigment ink includes black ink. As a result, the inkjet printer can easily provide a borderless image-carrier of high quality.

Figures 13A, 13B, 13C:
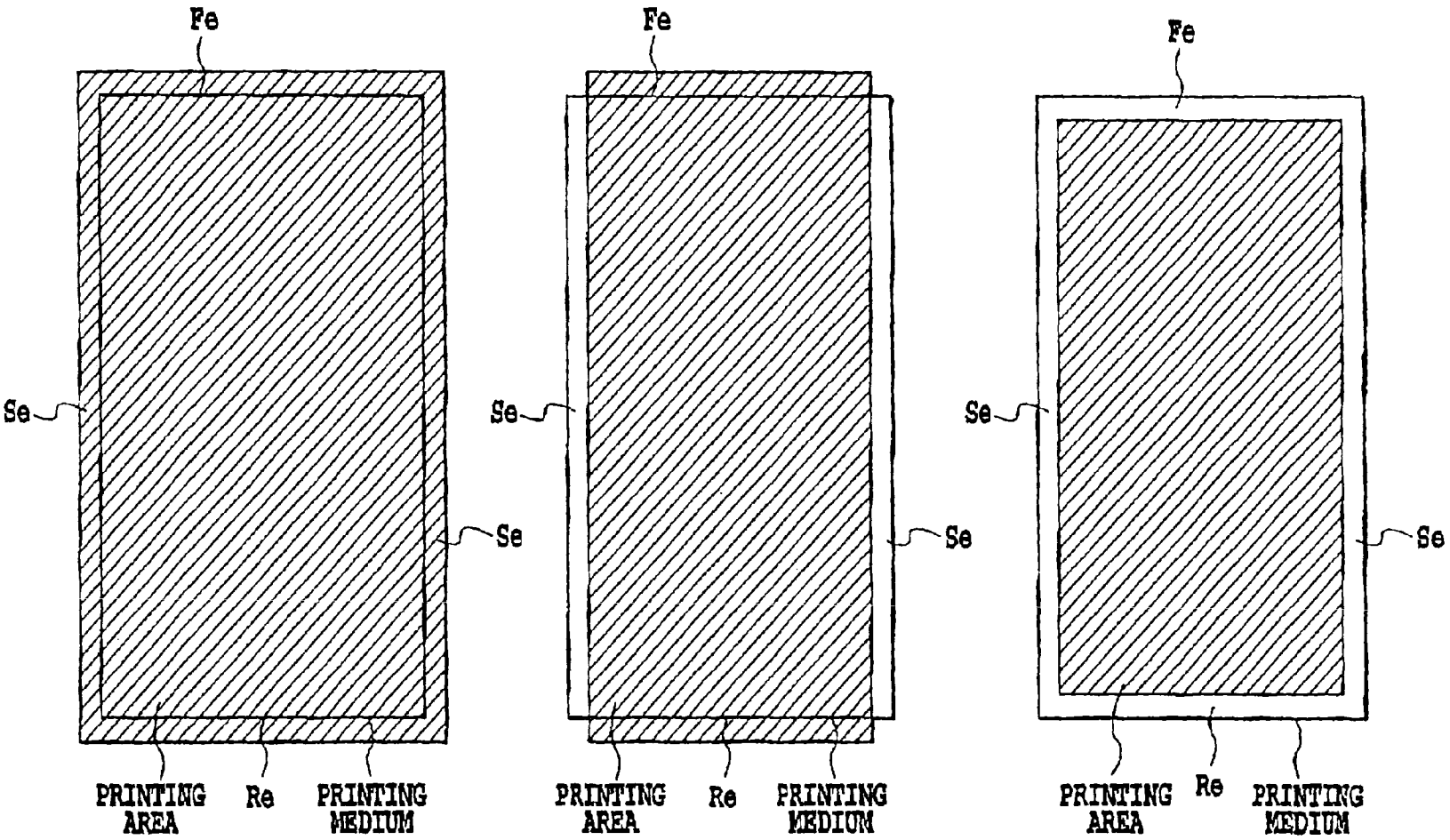
FIGS. 13A, 13B and 13C are schematic diagrams illustrating borderless printing.

"Borderless printing" in the present invention refers to a printing providing no margin for at least one edge of the printing face of the printing medium. For example, the borderless printing includes the printing shown in FIG. 13A where an image is printed on the entire area of the printing medium. In FIG. 13A, an image is printed on the area including all the four edges (front edge Fe, two side edges Se, and rear edge Re) of the printing medium. The borderless printing also includes the printing shown in FIG. 13B where an image is printed on the area including two edges (front edge Fe and rear edge Re in the medium transport direction). Furthermore, the borderless printing includes the printing where an image is printed on the area including only one edge of the printing medium. On the other hand, the borderless printing does not include the printing on an area excluding all the four edges of the printing medium, as illustrated in FIG. 13C. In other words, printing other than the borderless printing corresponds to a printing providing a margin for all of edges of the printing face of the printing medium.

Now the inkjet printer, the inkjet printing method, the program and the storage medium of the present invention will be described in detail with reference to the accompanying drawings.

FIG. 1 is a perspective view of a first embodiment of the inkjet printer according to the present invention. FIG. 1 illustrates an inkjet printer 1 capable of performing borderless printing as an example of the printer of the invention. The inkjet printer 1 includes a carriage 2 capable of scanning in the main scanning direction as indicated by arrow A, and a print head 3 capable of ejecting ink. The print head 3 is mounted on the carriage 2. The carriage 2 detachably holds an inkjet cartridge 4.

Figure 2:
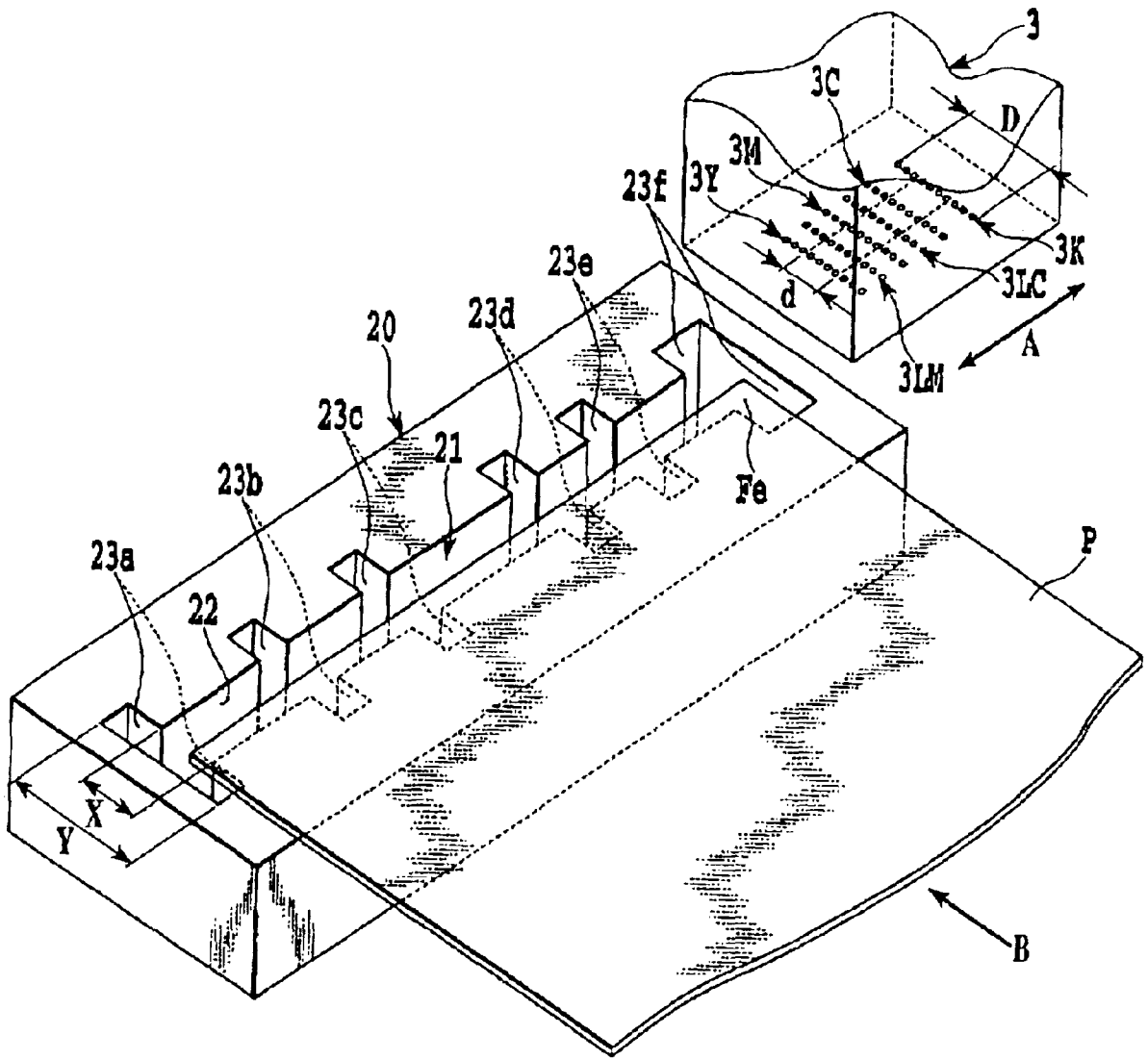
FIG. 2 is an enlarged perspective view of the inkjet printer of FIG. 1.

The inkjet cartridge 4 accommodates black (K) pigment ink and color dye ink including cyan (C) ink, light cyan (LC) ink, magenta (M) ink, light magenta (LM) ink and yellow (Y) ink. The black ink and the color inks are supplied from the inkjet cartridge 4 to the print head 3. Referring now to FIG. 2, the print head 3 has a nozzle array 3K for ejecting black pigment ink and five nozzle arrays 3C, 3LC, 3M, 3LM and 3Y for ejecting each of the color dye inks. Each of those nozzle arrays 3K–3Y includes a plurality of nozzles and has the same length "D".

The print head 3 includes electrothermal converting elements for transforming electric energy into thermal energy, and the thermal energy generated by the electrothermal converting elements causes film boiling in the ink. Each of the nozzle arrays 3K–3Y ejects ink utilizing the pressure change produced by bubble growth and shrinkage accompanying the film boiling. The electrothermal converting elements are provided with each of the nozzles in the nozzle arrays 3K–3Y, and a pulse voltage is applied to each electrothermal converting element for ink ejection.

As shown in FIG. 1, the carriage 2 is connected to the driving belt 6 of a transmitting mechanism 5. The transmitting mechanism 5 transmits the driving force of CR motor M1 to the belt 6. The carriage 2 is guided by a guide shaft 8 disposed in a chassis 7 so as to freely move in the main scanning direction shown by arrow A in the FIG. 1. The carriage 2 reciprocates along the guide shaft 8 when the CR motor M1 rotates in the normal or reverse direction. Moreover, a scale 9 is disposed in parallel to the guide shaft 8 in the chassis 7 to indicate the absolute position of the carriage 2 in the main scanning direction.

A medium feeder mechanism 10 is located on the back of the chassis 7. Printing media P such as A4 paper sheets, post cards and the like are placed on the medium feeder tray 11 of the medium feeder mechanism 10. The medium feeder mechanism 10 includes a separating roller (not shown) which is driven by a motor M2 (not shown in FIG. 1). Printing medium P is sent by the separating roller to a printing position opposite to the print head 3 on the carriage 2. A transport mechanism 12 is disposed in the chassis 7. The transport mechanism 12 has a transport roller and a discharge roller which are driven by transport motor M3 via a gear train GT. Printed medium P is transported by the transport mechanism 12 to an outlet tray (not shown).

The inkjet printer 1 has a recovery unit 15 including a capping unit 13 and a wiping unit 14, for example. When printing is not carried out, the capping unit 13 caps the print head 3, and nozzle recovery operations such as recycle recovery process and suction recovery process are conducted. The wiping unit 14 removes Ink that has adhered to the print head 3.

Referring now to FIG. 2, a platen 20 is disposed in the chassis 7 to be opposite to the print head 3 which reciprocates in the main scanning direction. The platen 20 defines the position of the printing medium P when images are printed thereon. In the inkjet printer 1, the medium feeder mechanism 10 conveys printing medium P to the platen 20 in the transport direction (direction B indicated by an arrow). The carriage 2 scans in the main scanning direction (direction A), while the print head 3 ejects pigment ink and dye ink onto printing medium P on the platen 20. As a result, an image is printed on printing medium P. The print head 3 is driven in accordance with ink ejection data, and the print head 3 ejects ink to print images.

An ink receiver 21 is formed on the platen 20 to be opposite to each of the nozzle arrays 3K–3Y of the print head 3. During borderless printing on the edges of printing medium P, the print head 3 ejects the black ink and color inks to the ink receiver 21 beyond printing medium P. The ink receiver 21 extends along the main scanning direction (direction A in the figure). The ink receiver 21 includes a primary depressed portion 22 and a plurality of secondary depressed portions 23*a*–23*f*. The primary depressed portion 22 is longer than the width of the widest printing medium P which can be used In the printer 1. The secondary depressed portions 23*a*–23*f* are formed in the platen 20 in the positions each corresponding to the side end of each of the printing media P such as A4 paper sheets, postcards and the like. The secondary depressed portions 23*a*–23*f* extend from the primary depressed portion 22 to both upstream and downstream directions in the transport direction (direction B) of printing medium P. The secondary depressed portions 23*a*–23*f* have a length "Y" in the transport direction for printing medium P. The length "Y" is a little longer than the length "D" of the nozzle arrays 3K–3Y of the print head 3.

In the secondary depressed portions 23*a*–23*f* of the present embodiment, the secondary depressed portion 23*a* at one end of the primary depressed portion 22 is used as the reference depressed portion opposite to one side edge of each printing medium. The secondary depressed portion 23*b* is opposed to the other side edge of a printing medium of the regular postcard size. The secondary depressed portion 23*c* is opposed to the other side edge of a printing medium of the L size. The secondary depressed portion 23*d* is opposed to the other side edge of a printing medium of the 2L size. The secondary depressed portion 23*e* is opposed to the other side edge of a printing medium of the 4"×6" size. The secondary depressed portion 23*f* is opposed to the other side edge of a printing medium of the A4 size and LTR. However, these secondary depressed portions 23*a*–23*f* may be omitted. In such a case, the ink receiver 21 (primary depressed portion 22) should has a length "Y" in the transport direction for printing medium P.

Figure 3:
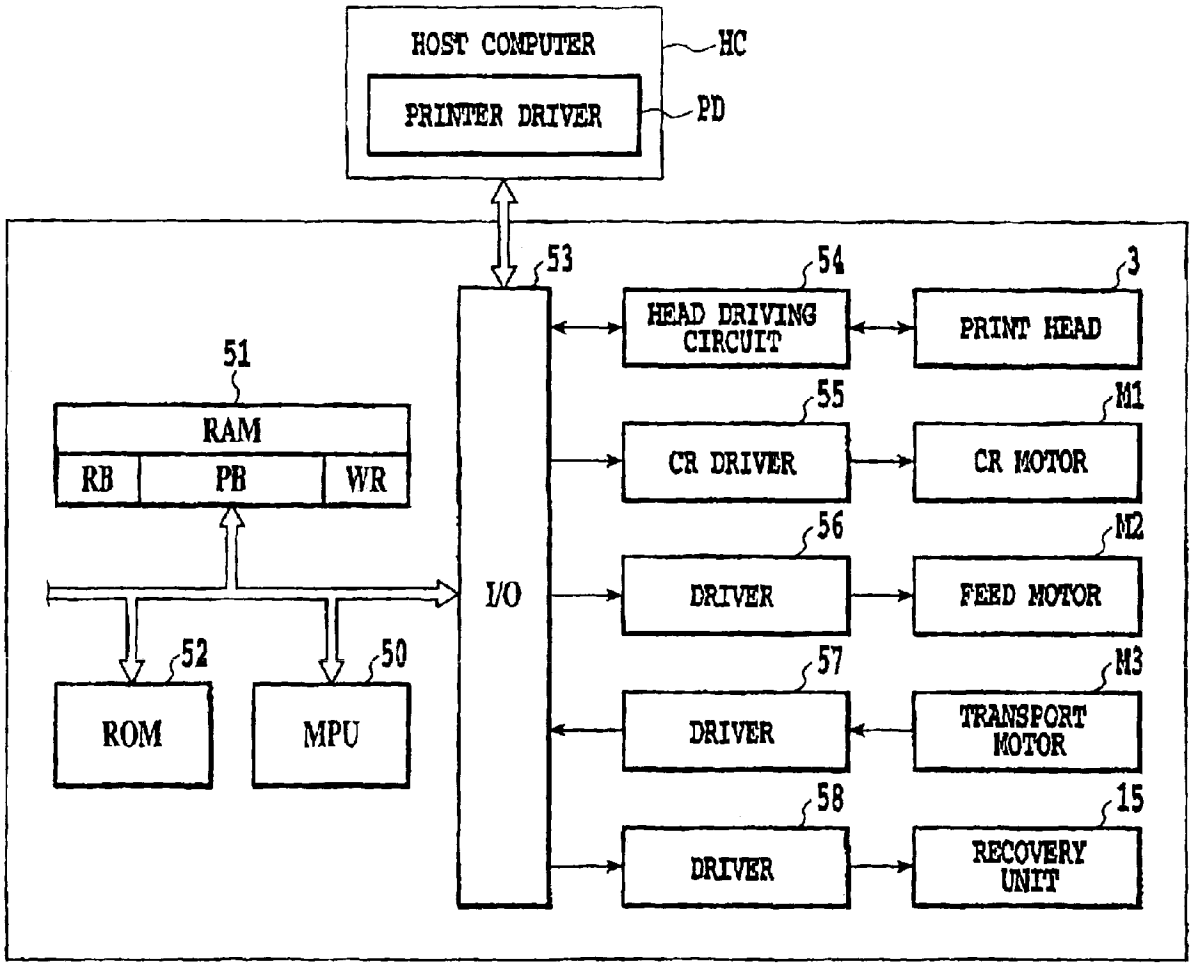
FIG. 3 is a block diagram for control of the inkjet printer of FIG. 1.

FIG. 3 is a diagram for control of the inkjet printer 1 shown in FIGS. 1 and 2. As shown in FIG. 3, the inkjet printer 1 includes a MPU 50 which serves as a controlling means for the printer 1. A RAM 51 and a ROM 52 are connected to the MPU 50 via a bus line. The RAM 51 includes a receiver buffer RB which temporarily holds various data, a print buffer PB and a work RAM WR which is used as a work area for various control calculations. ROM 52 stores various control programs.

Further, an input/output interface 53 is connected to the MPU 50 via the bus line. An external host computer HC is connected to the input/output interface 53. The above print head 3 is connected to the input/output interface 53 via a head driving circuit 54 so that the print head 3 is controlled by MPU 50. In the same manner, CR motor M1 for carriage driving and motor M2 for medium feeding are connected to the input/output interface 53 via a CR motor driver 55 and a motor driver 56, respectively. Transport motor M3 for medium transport and the recovery unit 15 are also connected to the input/output interface 53 via drivers 57, 58.

Next explained is the operation of the above inkjet printer 1. Now a detailed description is provided for an example where borderless printing is executed on an A4-size printing medium (paper) P.

Figure 4:
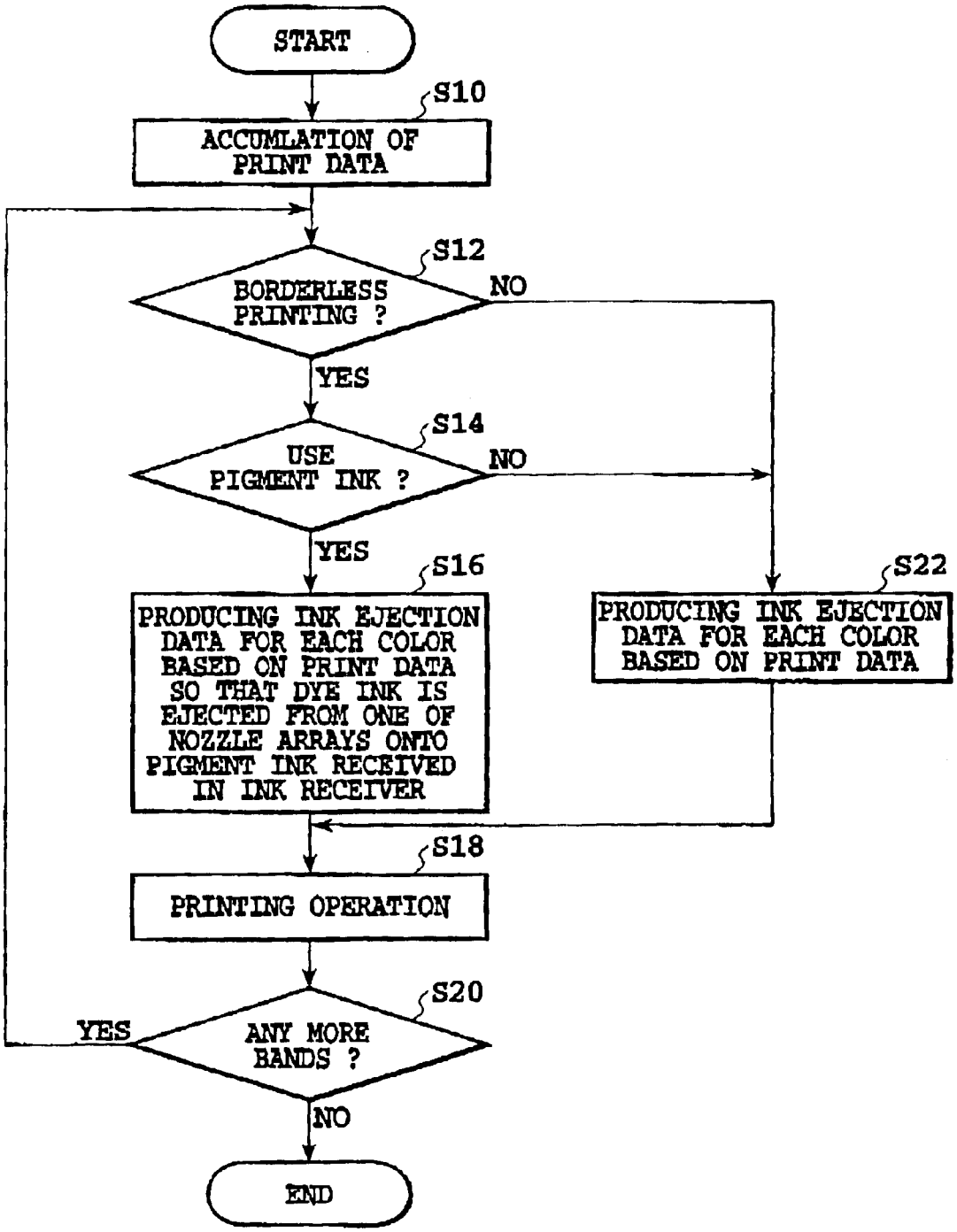
FIG. 4 is a flowchart illustrating the operation of the inkjet printer of FIG. 1.

As shown in FIG. 4, the data of characters or an image to be printed by the inkjet printer 1 (such as bit map data, hereinafter called "print data") is sent from host computer HC to the receiver buffer RB of RAM 51 via the input/output interface 53 (S10). The MPU 50 sends signals for confirming normal data transmission and status signals for the printer 1 back to the host computer.

When the print data of a predetermined band number are accumulated in receiver buffer RB, the MPU 50 of the printer 1 determines whether the width of the first band of print data to be printed on the edge of printing medium P is larger than the width of printing medium P, based on the print data for the first band (S12). It is then determined whether borderless printing should be executed on the edge of printing medium P (one of the front edge and two side edges). This determination for borderless printing may be made by another method. For example, a switch for setting the borderless printing mode may be provided for the printer. In such a case, is possible to determine whether borderless print should be executed or not by detecting ON state of the switch. Such a borderless printing mode may be set by a printer driver PD installed in host computer HC. In such a case, when a borderless printing mode is set by printer driver PD and MPU 50 has received a signal indicating such setting, MPU 50 determines to execute borderless printing. If it is determined in S12 to execute borderless printing, the MPU 50 of the printer 1 determines whether black pigment ink is used for the borderless printing or not (S14).

If it is determined that no borderless printing is executed (S12) or that no black pigment ink is used for the borderless printing (S14), the MPU 50 converts the print data into ejection data (S22) in accordance with regular procedures. Then, the MPU 50 executes printing (S18) in accordance with the ejection data produced in S22.

If it is determined that a borderless printing using black pigment ink will be executed (S14), the MPU 50 converts the print data for the first band into ejection data for each ink, and stores the data in print buffer PB (S16). In the step of S16, the MPU 50 produces data for ejecting color dye inks from the nozzles in one of the color ink nozzle arrays 3C–3Y (nozzles that do not eject ink for regular printing) toward the pigment ink ejected beyond printing medium P and received in the ink receiver 21 of the platen 20 during borderless printing. In other words, when borderless printing using pigment ink is executed in S16, dye ink ejection data for ejecting dye ink to the ink receiver 21 (dye ink ejection data for non-image printing), separate from the dye ink ejection data for printing images, are produced so that the pigment ink received in the ink receiver 21 contacts dye ink. As a result, the pigment ink is ejected into the ink receiver 21 in accordance with the pigment ink ejection data for image printing, while the dye ink is ejected into the ink receiver 21 in accordance with the dye ink ejection data for non-image printing.

The amount of color dye ink to be ejected onto black pigment ink in the ink receiver 21 is decided in accordance with the amount of black pigment ink ejected beyond printing medium P during borderless printing and received in the ink receiver 21. In detail, the ejection data for ejecting dye ink to the ink receiver 21 (namely, dye ink ejection data for non-image printing on the area lying off the printing medium) is produced in accordance with the ejection data for ejecting pigment ink to the ink receiver 21 (namely, pigment ink ejection data for the area lying off the printing medium). For example, the dye ink election data for non-image printing may be produced as same as the pigment ink ejection data for the area lying off the printing medium. Preferably, the dot number in the dye ink ejection data for the above non-image printing increases as the dot number in pigment ink ejection data for the area lying off the printing medium increases. According to the above configuration, the ejection amount of dye ink can be minimized while the solidification and accumulation of pigment ink is reduced, because more dye ink is ejected so as to dissolve pigment ink as more pigment ink is ejected to the ink receiver 21.

The dye ink ejection data for non-image printing may be predetermined constant data. That is, if there is pigment ink ejection data for the area lying off the printing medium, dye ink may be ejected to the area lying off the printing medium in accordance with the predetermined constant data. The predetermined constant data may be such data with which dye ink is ejected onto all the area lying off the printing medium or such data with which dye ink is ejected onto part of the area lying off the printing medium. The number of nozzle arrays 3C–3Y for ejecting color dye inks onto the black pigment ink received in the ink receiver 21 is determined in accordance with the amount of black ink ejected beyond printing medium P during borderless printing and received in the ink receiver 21.

When borderless printing is executed on the front edge Fe of printing medium P (FIG. 2), in S16, the MPU 50 produces ejection data so that ink is not ejected from all the nozzles corresponding to the entire length "D" (FIG. 2) of the nozzle arrays 3K–3Y, but from only the nozzles within a predetermined length "d(d<D)" in the center of the nozzle arrays. In this way, by using part of nozzles of the nozzle arrays 3K–3Y for borderless printing on the front edge Fe of printing medium P, there will be no need to make the length X of the primary depressed portion 22 of the ink receiver 21 beyond necessity, and the platen 20 can securely hold printing medium P. The ink spread off the sides of the front edge Fe of printing medium P during borderless printing is received by the secondary depressed portions 23*a* and 23*f* that have a length "Y" larger than the length "X" of the primary depressed portion 22.

After step S16, the print head 3 begins printing on printing medium P (S18). In this case, printing medium P is separated one by one and transported by the feeder mechanism 10 and further transported by a transport mechanism 12 in the direction B (indicated by an arrow in FIG. 2). As illustrated in FIG. 2, when the front edge Fe of printing medium P has come close to the center of the ink receiver 21 of the platen 20 in direction B (transport direction), the print head 3 moves in the main scanning direction (direction A), and borderless printing is executed on the front edge Fe of printing medium P.

Figure 5:
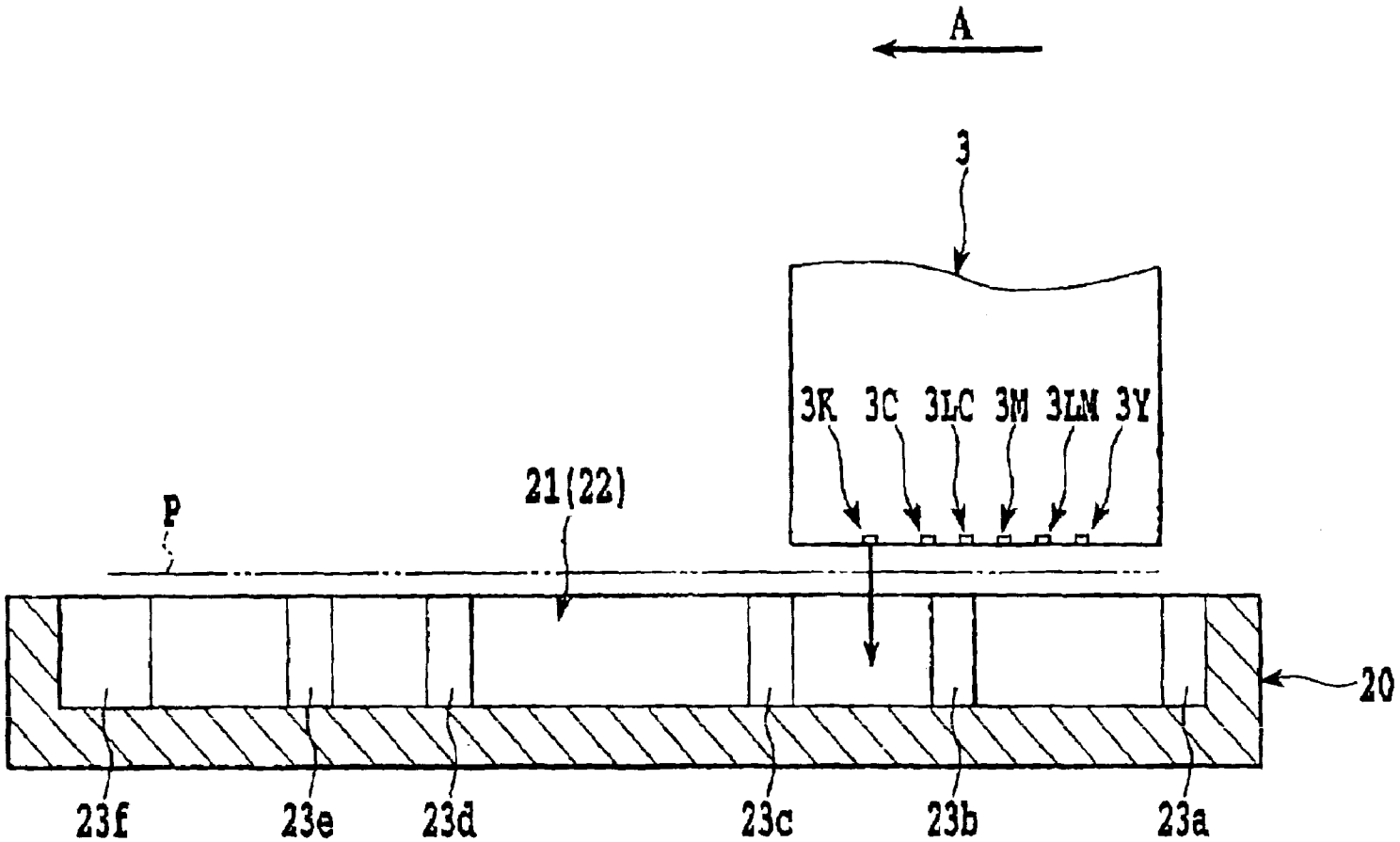
FIG. 5 is a sectional view illustrating the operation of the inkjet printer of FIG. 1.
Figure 6:
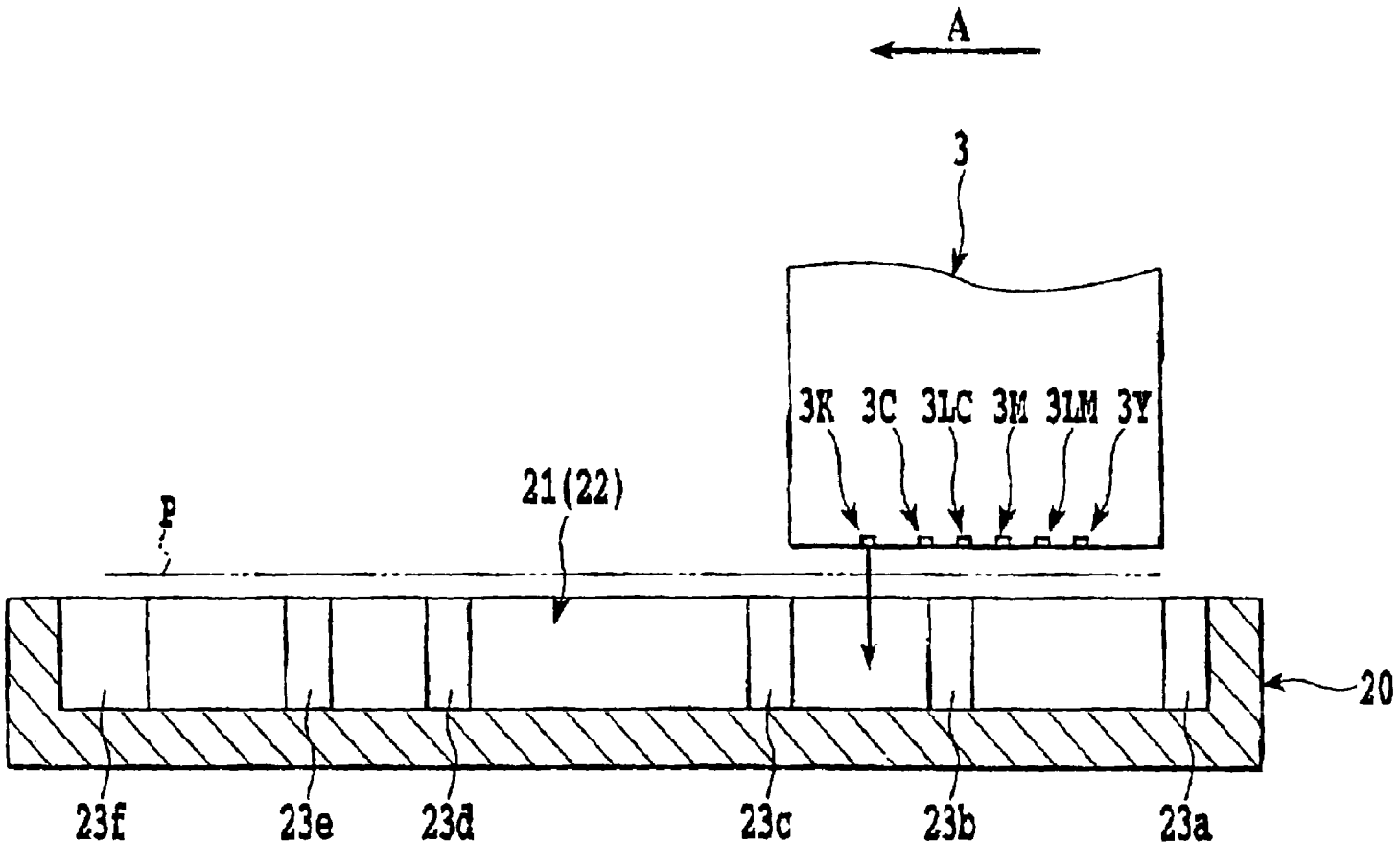
FIG. 6 is a sectional view illustrating the operation of the inkjet printer of FIG. 1.

As shown in FIG. 5, when black pigment ink is ejected from the nozzles corresponding to the predetermined length "d" of the nozzle array 3K of the print head 3, part of the ejected black ink spreads off printing medium P and is received in the ink receiver 21. Then, in the inkjet printer 1, as the print head 3 moves in the scan direction (direction A in the figure), color dye ink is ejected from part of the nozzles of, for example, the nozzle array 3LC toward the black pigment ink BI received in the ink receiver 21, as shown in FIG. 6.

After the printing operation is completed in S18, the MPU 50 determines whether the print data for the next band exists in receiver buffer RB or not (S20). If such printing data exists in receiver buffer RB, above described steps S12–S22 are repeated.

Figure 7:
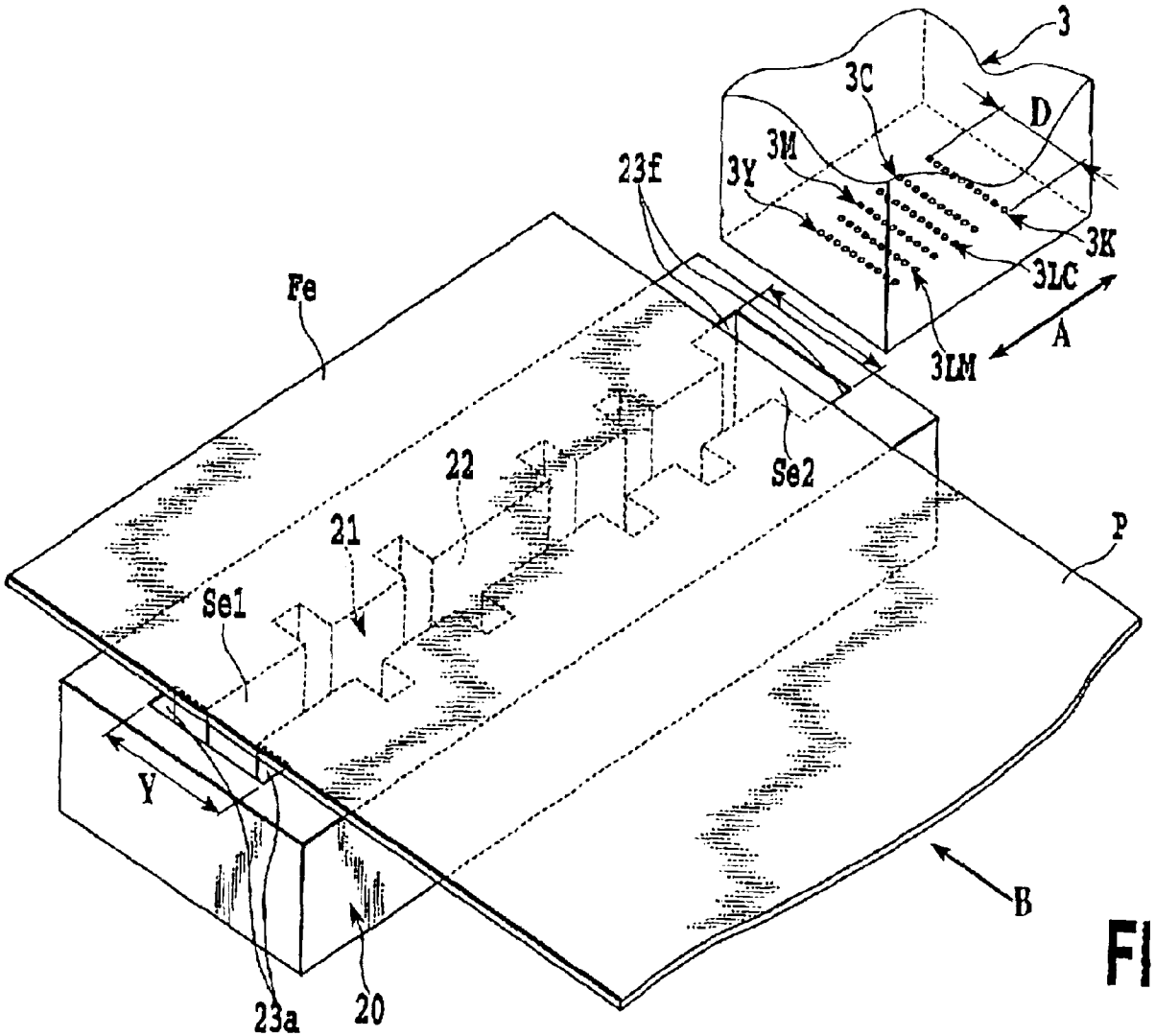
FIG. 7 is an enlarged perspective view of the inkjet printer of FIG. 1, illustrating the operation of the inkjet printer of FIG. 1.

When borderless printing is executed on the side edge Se1 on the reference side and the side edge Se2 on the non-reference side of printing medium P after borderless printing on the front edge Fe of printing medium P is completed, as shown in FIG. 7, the MPU 50 produces ejection data so that all the nozzles corresponding to the entire length "D" of the nozzle arrays 3K–3Y eject ink (S16). The ink lying off the sides of front edge Fe of printing medium P during borderless printing is received by the secondary depressed portions 23*a* and 23*f* that have a length "Y" larger than the length "X" of the primary depressed portion 22. Also in this case, during the borderless printing in S18, some nozzles in the nozzle arrays 3C–3Y eject color dye ink toward the pigment ink received in the ink receiver 21.

Figure 8:
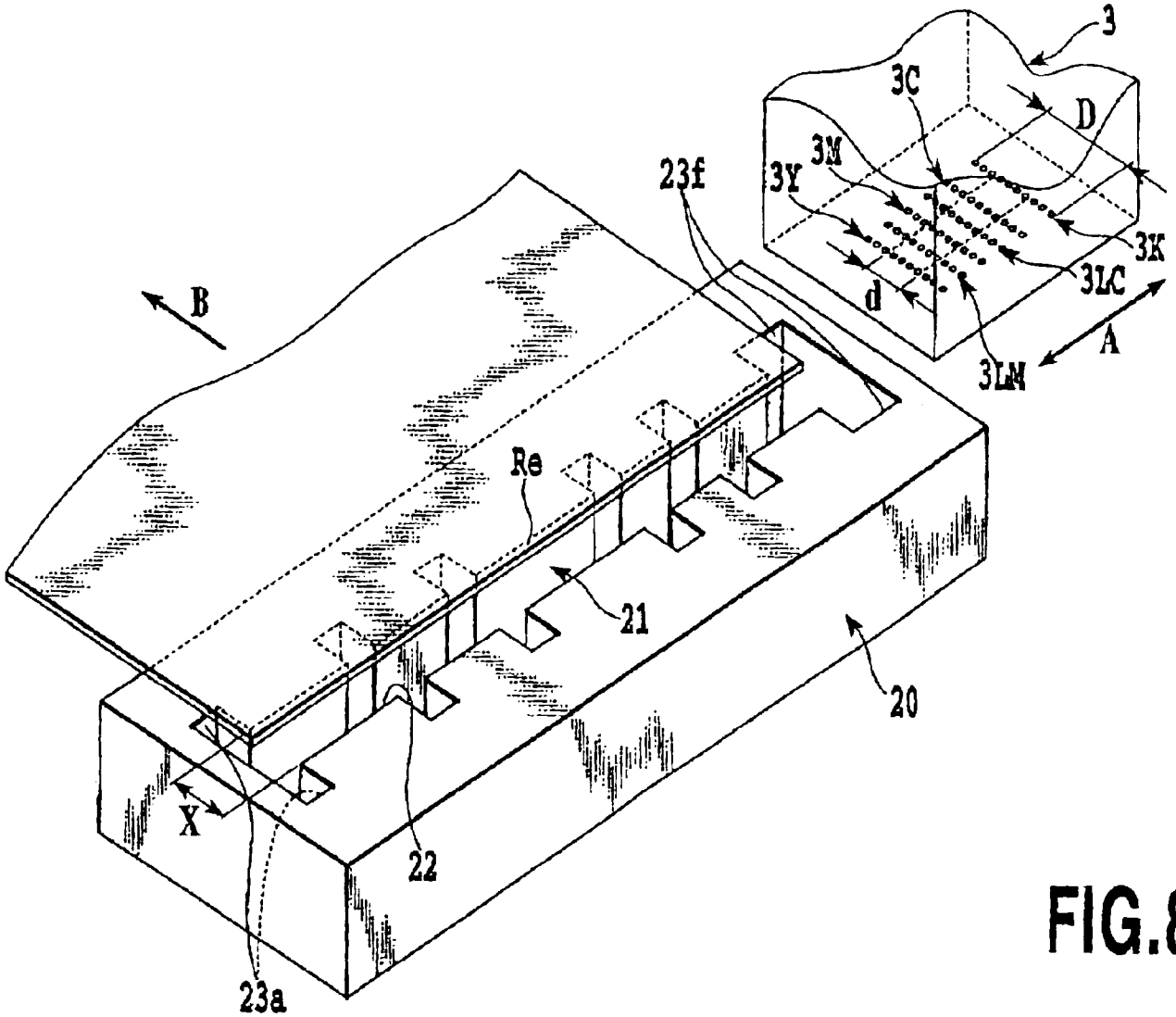
FIG. 8 is an enlarged perspective view the inkjet printer of FIG. 1, illustrating the operation of the inkjet printer of FIG. 1.

When borderless printing is executed on the rear edge Re of printing medium P as shown in FIG. 8, MPU 50 produces ejection data so that ink is not elected from all the nozzles corresponding to the entire length "D" (FIG. 2) of the nozzle arrays 3K–3Y, but from only the nozzles corresponding to a predetermined length "d" (d<D) in the center of the nozzle arrays in the same manner as printing on the front edge Fe of printing medium P (S16). During borderless printing of S18, nozzles in one of the nozzle arrays 3C–3Y eject color dye ink toward the pigment ink received in the ink receiver 21. The printed printing medium P is then transported by the transport mechanism 12 to the outlet tray (not shown).

As described above, when black pigment ink is ejected into the ink receiver 21 of the platen 20 during borderless printing in the inkjet printer 1, color dye ink is ejected toward black ink BI received in the ink receiver 21. Then black pigment ink BI in the ink receiver 21 is diluted by color dye ink, or black ink BI adhering to the ink receiver 21 is dissolved by color dye ink. As a result, in the inkjet printer 1, the solidification and accumulation of black pigment ink in the ink receiver 21 of the platen 20 during borderless printing is prevented with reliability. Image quality and printer operation reliability can thereby be improved.

Further, in the printer 1, both black ink and color ink are ejected from the nozzles corresponding to the length "d" in the center of the nozzle arrays to front edge Fe and rear edge Re of printing medium P. Similarly, both black ink and color ink are ejected from the nozzles corresponding to the entire length "D" of the nozzle arrays 3K–3Y to side edges Se1 and Se2 of printing medium P.

Therefore, the ejection of black pigment ink for borderless printing and the ejection of color dye ink onto black ink BI received in the ink receiver 21 (see FIG. 6) can be done during one scanning of the print head 3. Because color ink is ejected onto the black ink soon after the black ink has been ejected in the ink receiver 21, the solidification and accumulation of black ink in the ink receiver 21 of the platen 20 can be prevented with reliability.

Figure 9:
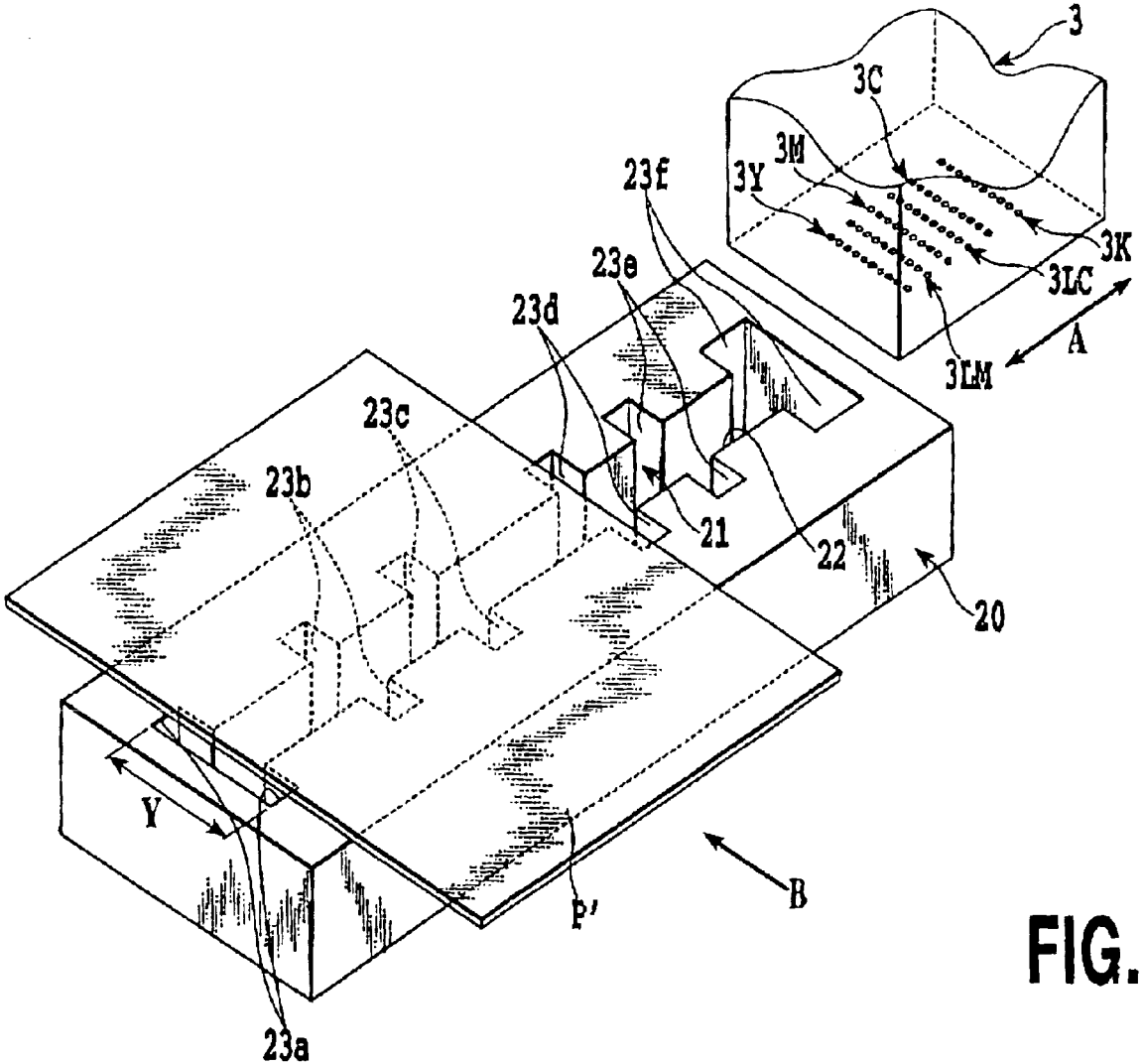
FIG. 9 is an enlarged perspective view of the inkjet printer of FIG. 1, illustrating the operation of the inkjet printer of FIG. 1.

So far, borderless printing on an A4-size printing medium P has been described However, as illustrated in FIG. 9, the inkjet printer 1 can execute a similar borderless printing on the printing media other than A4-size, The example shown in FIG. 9 is a printing on an L-size printing medium P'. In this case, the ink lying off printing medium P during borderless printing is received by the primary depressed portion 22, the secondary depressed portion 23*a* on the reference side and the secondary depressed portion 23*d* corresponding to L size media.

In the above example, a series of operations shown in the flowchart of FIG. 4 have been executed by the inkjet printer 1, however, all the operations or part of them can be executed by the printer driver PD on the host computer HC. For example, a borderless printing mode may be set or the data preparation for borderless printing mode (preparation of dye ink ejection data for non-image printing so as to contact dye ink with the pigment ink ejected to the ink receiver) may be executed on the printer driver PD installed on the host computer HC. In such a case, the printer 1 does not produce ejection data but only executes printing in accordance with the data sent from the host computer HC.

Figure 10:
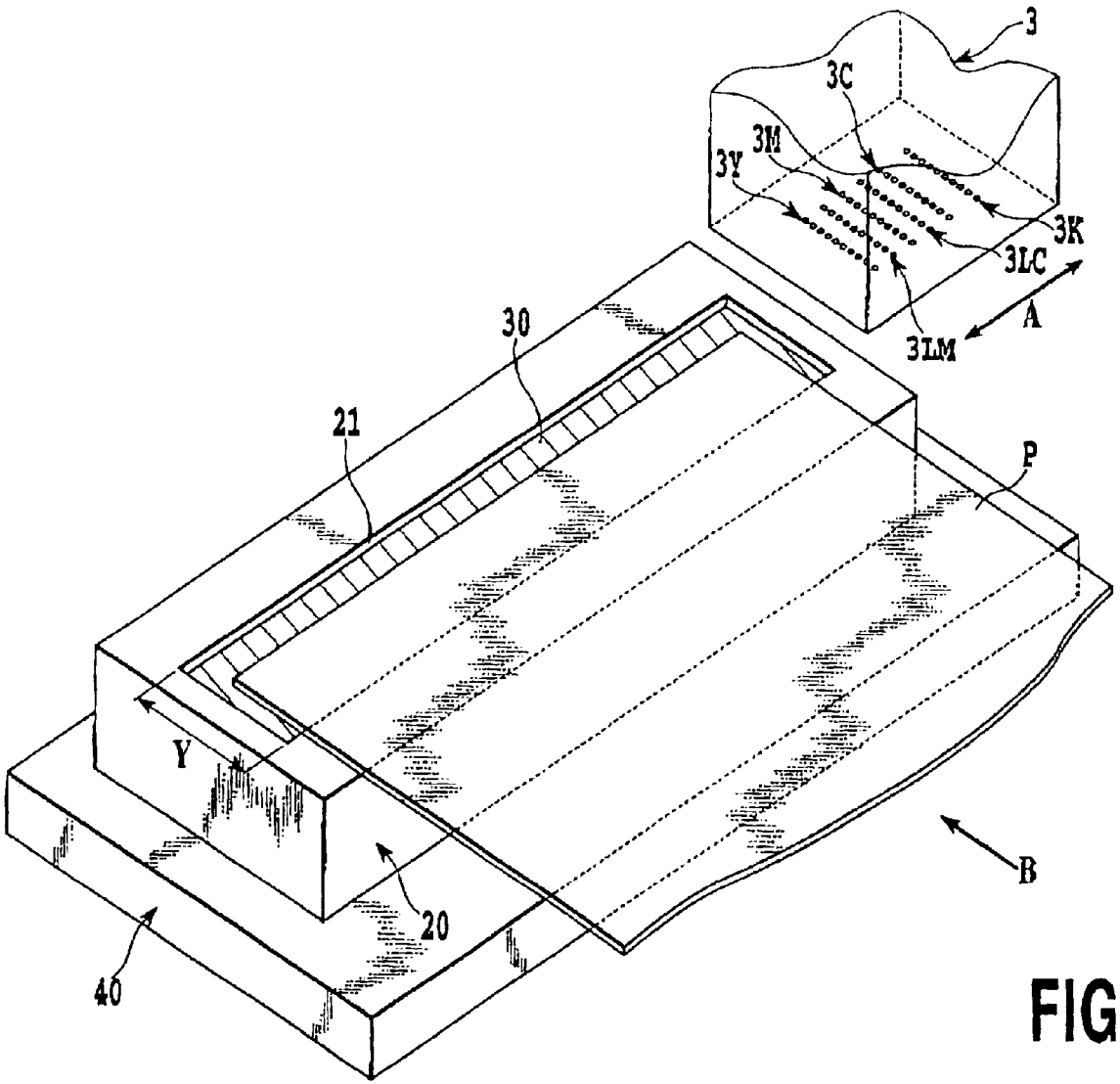
FIG. 10 is an enlarged perspective view of a second embodiment of the inkjet printer of the present invention.
Figure 11:
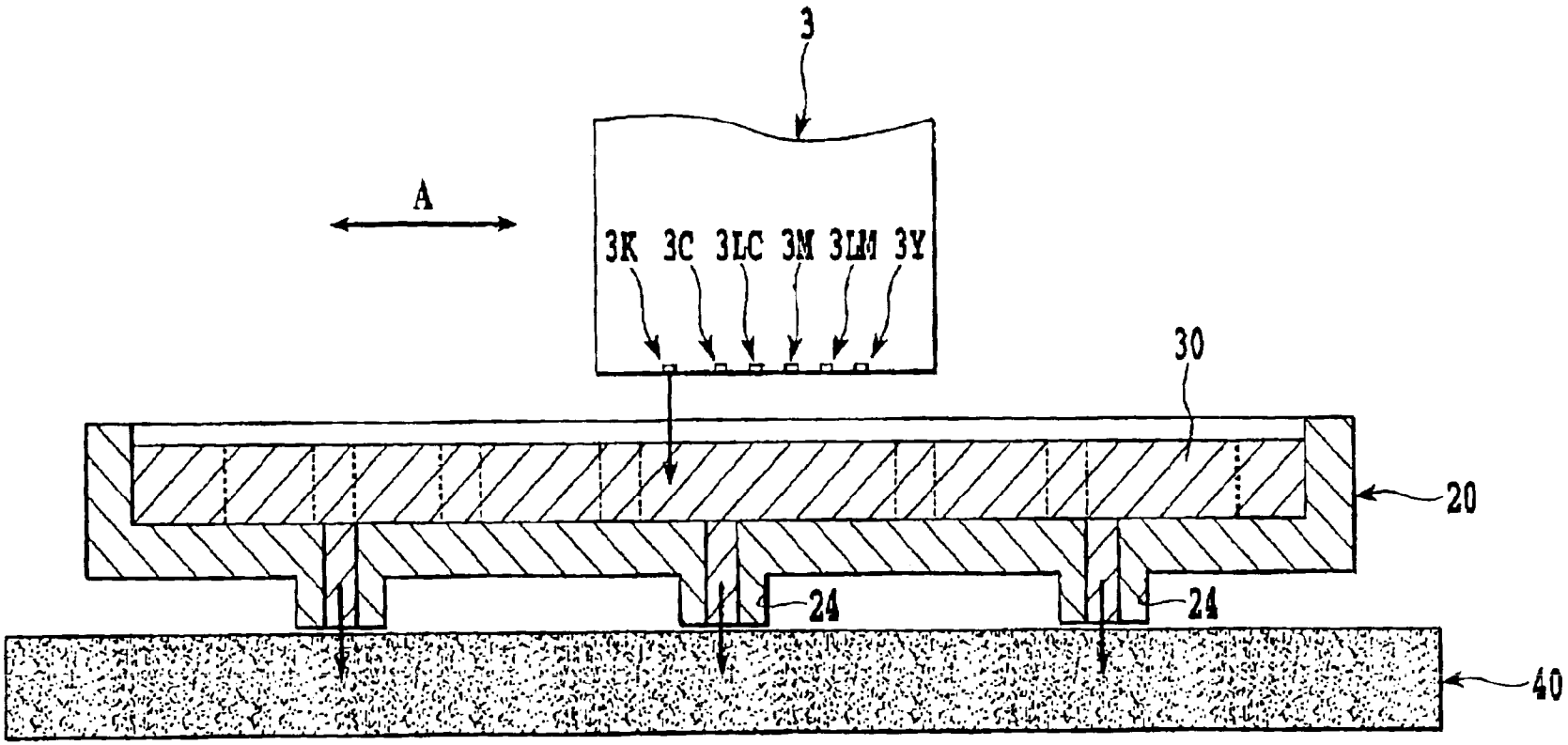
FIG. 11 is an enlarged sectional view of the inkjet printer of FIG. 10.

FIG. 10 is an enlarged perspective view of a second embodiment of the inkjet printer of the present invention. In this embodiment, an ink absorber 30 is disposed in the ink receiver 21 of the platen 20. The ink absorber 30 is made of material such as sponge through which ink easily passes As shown in FIGS. 10 and 11, a waste ink disposal member 40 is also disposed under the platen 20 in this embodiment. The waste ink disposal member 40 is made of material such as felt which can absorb and hold ink. The platen 20 has a plurality of ink flow paths 24 communicating the ink receiver 21 with the waste Ink disposal member 40. As shown in FIG. 11, the ink flow paths 24 may include the ink absorber 30.

Under such a configuration, the ink absorber 30 prevents scattering of ink (mist) ejected so as to spread off printing medium P during borderless printing. In this configuration as well, the solidification and accumulation of black pigment ink in the ink absorber 30 and clogging in the ink absorber 30 can be prevented by ejecting color dye ink to the black pigment ink received by the ink absorber 30 of the ink receiver 21 during borderless printing.

In the present embodiment, the ink received by the ink absorber 30 of the ink receiver 21 moves in a liquid state to the waste ink disposal member 40 disposed under the platen 20 via the ink flow paths 24. As a result, the amount of black pigment ink accumulated in the ink receiver 21 can be minimized, and the reliability and durability of the inkjet printer 1 can be improved.

In FIG. 10, the ink receiver 21 of the platen 20 has a uniform length "Y" in the direction B, however, the ink receiver 21 of the second embodiment may have another configuration. For example, the ink receiver 21 of the second embodiment may have the primary depressed portion and a plurality of secondary depressed portions as shown in FIG. 2. Further, either the ink absorber 30 or waste ink disposal member 40 may be omitted in the ink receiver 21 of the second embodiment.

Figure 12:
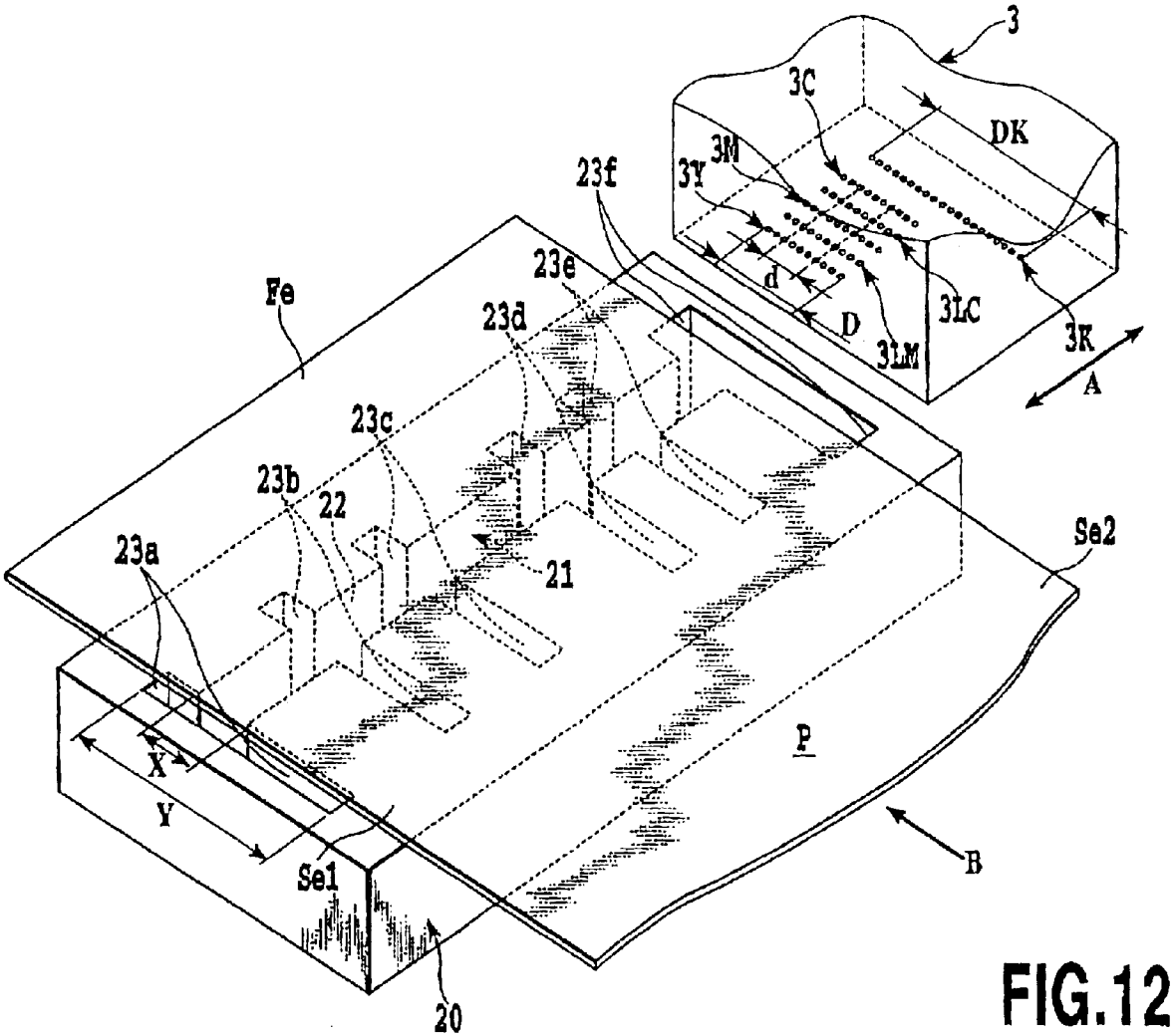
FIG. 12 is an enlarged perspective view of a third embodiment of the inkjet printer of the present invention.

FIG. 12 is an enlarged perspective view of a third embodiment of the inkjet printer of the present invention. In this embodiment, the color ink nozzle arrays 3C–3Y of the print head 3 have the same length "D", while the nozzle array 3K for black pigment ink has a length DK2 larger than that of the other nozzle arrays 3C–3Y. The platen 20 opposite to the print head 3 is almost the same as that shown in FIG. 2. On the other hand, the length "Y" of the secondary depressed portions 23*a*–23*f* is slightly larger than that of the nozzle array 3K for black pigment ink. Under this configuration, both black ink and color ink are ejected from the nozzles corresponding to the same length "d" in the center of the nozzle arrays to front edge Fe and rear edge Re of printing medium P. As a result, in this case, the ejection of black pigment ink for borderless printing and the ejection of color dye ink onto the black ink received in the ink receiver 21 can be executed during one scanning of the print head 3.

On the other hand, when borderless printing is executed on the side edges Se1 and Se2 except for front edge Fe and rear edge Re in the present embodiment, the black pigment ink is ejected from all the nozzles of the nozzle array 3K. In this embodiment, however, the length "DK" of the black ink nozzle array 3K is larger than the length "D" of the other color ink nozzle arrays 3C–3Y. Therefore, the ejection of black pigment ink for borderless printing on the side edges Se1 and Se2 and the ejection of color dye ink onto the black ink received in the ink receiver 21 cannot be executed during one scanning of the print head 3.

To solve this problem, in this embodiment, color dye ink is ejected onto the black pigment ink received in the ink receiver 21 one or more scannings after the scanning including the ejection of black pigment ink for borderless printing. As a result, the solidification and accumulation of black pigment ink in the ink receiver 21 of the platen 20 can be prevented with reliability even when the length "DK" of the nozzle array 3K for black pigment ink is larger than the length "D" of the other nozzle arrays for color inks.

In the above embodiments, color dye ink is ejected onto the black pigment ink received in the ink receiver 21 during printing operation. However, the present invention is not limited to such a configuration. Color dye inks may be ejected onto the black pigment ink received in the ink receiver 21 even after the scanning including the ejection of black pigment ink for borderless printing. Namely, color dye inks may be ejected onto the black pigment ink received in the ink receiver 21 after the printing operation. In short, the ejection of color dye ink for preventing the solidification and accumulation of black pigment ink in the ink receiver 21 of the platen 20 may be carried out as part of the ejection recovery process, independently of the regular printing operation.

In such a case, color ink is ejected onto the black ink in the ink receiver 21 after a predetermined period of time has lapsed after black pigment ink was received in the ink receiver 21 of the platen 20 during borderless printing. Thus, it is preferable to change the amount of color dye ink ejection so as to be minimized corresponding to the lapse of time since black pigment ink has been received in the ink receiver 21. It is also preferable to change the amount of color dye ink ejection when a considerable time has passed after black pigment ink was ejected because, for example, the printer 1 was unplugged during printing and left as it was.

At all events, it is preferable that the amount of color dye ink ejected onto black pigment ink in the ink receiver 21 is varied according to the amount of black ink received in the ink receiver 21. Preferably, the amount of color dye ink is determined from the amount of black ink ejected to the ink receiver 21 of the platen 20 for borderless printing in accordance with the print data for printing images on printing medium P, so that the black ink in the ink receiver 21 is sufficiently diluted and dissolved. As a result, the amount of color dye ink used for preventing the solidification and accumulation of black pigment ink in the ink receiver 21 of the platen 20 can be minimized.

[Other Embodiments ]

In the printers of the first to third embodiments, color dye ink is ejected onto black pigment ink in the ink receiver of the platen during borderless printing, however, the dye ink ejected onto black pigment ink may be a black ink rather than a color ink. Other than the black pigment ink (K) and color dye inks (C, LC, M, LM, Y), black dye ink may be used and ejected onto black pigment ink received in the ink receiver during borderless printing. Further, both black dye ink and color dye ink may be ejected onto the black pigment ink received in the ink receiver. Furthermore, color pigment ink and black dye ink may be used and the black dye ink may be ejected onto the color pigment ink received in the ink receiver. In any cases, the solidification and accumulation of pigment ink in the ink receiver and/or the ink absorber can be reduced by contacting dye ink with the pigment ink received in the ink receiver and by diluting/dissolving the pigment ink in the ink receiver and/or the ink absorber with dye ink.

The objective of the present invention may also be achieved by providing an apparatus or system with a storage medium which stores software program code capable of realizing the functions described in the above embodiments. The computer (CPU or MPU) of such apparatus or system reads and executes the program code stored in the storage medium.

In such a case, the program code itself realizes the functions of the above embodiments. The storage medium storing the program code and program code itself are included in the scope of the present invention.

The storage medium of the present invention stores the program code corresponding to the flowchart of FIG. 4 for example. In this case, the program code corresponding to S12, S14 and S16 in the flowchart of FIG. 4 is important. In other words, the important program code is that for preparing the dye ink ejection data (dye ink ejection date for non-image printing) for ejecting dye ink to the ink receiver 21, separate from the dye ink ejection data (dye ink ejection data for image printing) for regular printing, when the borderless printing mode is activated and pigment ink is ejected.

Storage media for storing the program include, for example, a floppy (registered trademarks) disk, a CD-ROM, a hard disk devise, an optical disk, a magnetic optical disk, a CD-R, a CD-RW, a DVD, a magnetic tape, a nonvolatile memory card, a ROM, etc.

Further, the functions of the above-mentioned embodiments can be achieved by a computer that read out the program of the present invention and executes the program. Moreover, the Operating System on the computer may execute all or a part of the actual process in accordance with the instruction from the program. Such operations are also included in the scope of the present invention.

Further, the program stored in a storage medium may be written into a function extended board inserted into a computer or into memory of a function extended unit connected to a computer, and the function extended board or a CPU of the function extended unit can execute all or a part of the actual processes. Such operations are also included in the scope of the present invention.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An inkjet printer capable of printing an image on a printing medium by ejecting ink in accordance with print data from a print head including nozzle arrays for pigment ink and dye ink, said inkjet printer comprising:

a platen opposite to said print head, said platen defining a position of the printing medium for image printing; and an ink receiver formed in said platen to be opposite to said nozzle arrays of said print head, said ink receiver receiving ink ejected off the printing medium during borderless printing for printing providing no margin on at least one edge of the printing medium, wherein dye ink is ejected toward pigment ink received in said ink receiver during borderless printing using pigment ink.

2. The inkjet printer as set forth in claim 1, wherein an ink absorber is disposed in said ink receiver.

3. The inkjet printer as set forth in claim 1 further comprising:

a waste ink disposal member disposed under said platen; and an ink flow path formed in said platen, said ink flow path communicating said ink receiver with said waste ink disposal member.

4. The inkjet printer as set forth in claim 1, wherein the amount of dye ink ejected onto pigment ink in said ink receiver is varied in accordance with the amount of pigment ink received in said ink receiver during borderless printing.

5. The inkjet printer as set forth in claim 1, wherein an ejection of pigment ink for borderless printing and an ejection of dye ink onto the pigment ink received in the said ink receiver are executed during one scanning by the print head.

6. The inkjet printer as set forth in claim 1, wherein dye ink is ejected onto pigment ink received at a previous scanning in said ink receiver during scanning one or more after said previous scanning.

7. The inkjet printer as set forth in claim 1, wherein dye ink is ejected onto pigment ink received in said ink receiver after a scanning including a pigment ink ejection for borderless printing is completed.

8. The inkjet printer as set forth in claim 1, wherein dye ink is ejected onto pigment ink received in said ink receiver after a predetermined period of time has lapsed since pigment ink is received in said ink receiver during borderless printing.

9. The inkjet printer as set forth in claim 8, wherein the amount of dye ink to be ejected is varied in accordance with the lapse of time after pigment ink is received in said ink receiver.

10. The inkjet printer as set forth in claim 1, wherein said dye ink includes cyan ink, magenta ink and yellow ink and said pigment ink includes black ink.

11. An inkjet printer having a borderless printing mode for printing providing no margin on at least one edge of a printing medium with a print head capable of ejecting pigment ink and dye ink, said inkjet printer comprising:

a platen opposite to print head, said platen defining a position of the printing medium for printing with said print head; and an ink receiver formed in the platen so as to receive ink ejected off the printing medium during said borderless printing mode, wherein dye ink in addition to pigment ink is ejected to said ink receiver during said borderless printing mode using pigment ink.

12. An inkjet printer comprising:

a platen opposite to a print head capable of ejecting pigment ink and dye ink, said platen defining a position of a printing medium for printing with said print head;

an ink receiver formed in said platen, said ink receiver receiving ink ejected off the printing medium during a borderless printing mode in which borderless printing is executed on at least one edge of the printing medium; and a driver means for driving said print head in accordance with ink ejection data and making the print head eject ink, wherein both pigment ink and dye ink are ejected to said ink receiver during said borderless printing mode using pigment ink in accordance with pigment ink ejection data for image printing and dye ink ejection data for non-image printing.

13. An inkjet printing method for an inkjet printer including a platen opposite to a print head having nozzle arrays for pigment ink and dye ink, said platen defining a position of a printing medium for printing with said print head; and an ink receiver formed in said platen to be opposite to said nozzle arrays of said print head, said ink receiver receiving ink ejected off the printing medium during borderless printing, said method comprising the step of:

ejecting dye ink toward pigment ink that has been ejected off the printing medium and received in said ink receiver during borderless printing using pigment ink.

14. An inkjet printing method for an inkjet printer including a platen opposite to a print head capable of ejecting pigment ink and dye ink, said platen defining a position of a printing medium for printing with said print head; and an ink receiver formed in said platen, said ink receiver receiving ink ejected off the printing medium during a borderless printing mode in which borderless printing is executed on at least one edge of the printing medium, said method comprising the step of:

printing an image on the printing medium by ejecting ink from said print head, wherein during said borderless printing mode using pigment ink, dye ink in addition to the pigment ink is ejected to said ink receiver so as to be in contact with pigment ink received in said ink receiver.

15. An inkjet printing method for an inkjet printer including a platen opposite to a print head capable of ejecting pigment ink and dye ink, said platen defining a position of a printing medium for printing with said print head; and an ink receiver formed in said platen, said ink receiver receiving ink ejected off the printing medium during a borderless printing mode in which borderless printing is executed on at least one edge of the printing medium, said method comprising the step of:

driving said print head in accordance with ink ejection data so as to print an image on the printing medium by ejecting ink from said print head, wherein, during said borderless printing mode using pigment ink, both pigment ink and dye ink are ejected to said ink receiver in accordance with pigment ink ejection data for image printing and dye ink ejection data for non-image printing.

16. A computer program product for an inkjet printer including a platen opposite to a print head capable of ejecting pigment ink and dye ink, said platen defining a position of a printing medium for printing with said print head; and an ink receiver formed in said platen, said platen receiving ink ejected off the printing medium during a borderless printing mode in which borderless printing is executed on at least one edge of the printing medium, said computer program product comprising:

computer-readable program code means for controlling said print head to eject dye ink in addition to pigment ink to said ink receiver during said borderless printing mode using pigment ink.

17. A computer-readable storage medium storing the computer program of claim 16.

18. A computer program product for an inkjet printer including a platen opposite to a print head capable of ejecting pigment ink and dye ink, said platen defining a position of a printing medium for printing with said print head; and an ink receiver formed in said platen, said ink receiver receiving ink ejected off the printing medium during a borderless printing mode in which borderless printing is executed on at least one edge of the printing medium, said computer program product comprising:

computer-readable program code means for producing dye ink ejection data for non-image printing, separate from ejection data for image printing, so that said print head ejects dye ink in addition to pigment ink to said ink receiver during said borderless printing mode using pigment ink.

19. A computer-readable storage medium storing the computer program of claim 18.

20. A computer program product for an inkjet printer including a platen opposite to a print head capable of ejecting pigment ink and dye ink, said platen defining a position of a printing medium for printing with said print head; and an ink receiver formed in said platen, said ink receiver receiving ink ejected off the printing medium during a borderless printing mode in which borderless printing is executed on at least one edge of the printing medium, said computer program product comprising:

computer-readable program code means for producing ejection data so that both pigment ink and dye ink are ejected to said ink receiver in accordance with pigment ink ejection data for image printing and on dye ink ejection data for non-image printing.

21. A computer-readable storage medium storing the computer program of claim 20.

* * * * *